US005340377A

United States Patent [19]

Accary et al.

[11] Patent Number: 5,340,377

[45] Date of Patent: Aug. 23, 1994

[54] METHOD AND APPARATUS FOR PRODUCING POWDERS

[75] Inventors: Andre Accary, Paris; Jean Coutiere, St. Georges de Mons; Andre Lacour, Royat, all of France

[73] Assignee: Aubert & Duval, Neuilly sur Seine, France

[21] Appl. No.: 919,028

[22] Filed: Jul. 23, 1992

[30] Foreign Application Priority Data

Jul. 25, 1991 [FR] France ..... 91 09462

[51] Int. Cl.[5] ..... B22F 9/10

[52] U.S. Cl. ..... 75/334; 75/336; 75/338; 75/346

[58] Field of Search ..... 75/333, 334, 336, 338, 75/346

[56] References Cited

U.S. PATENT DOCUMENTS 4,474,604 10/1984 Nakamura et al. ..... 75/333
4,781,754 11/1988 Soranno et al. ..... 75/346
5,084,091 1/1992 Yolton ..... 75/336

FOREIGN PATENT DOCUMENTS 2276121 6/1975 France .
2595595 9/1987 France .
2629573 10/1989 France .
8705548 9/1987 PCT Int'l Appl. .
89/00470 1/1989 PCT Int'l Appl. ..... 75/334

*Primary Examiner*—George Wyszomierski
*Attorney, Agent, or Firm*—Lawrence M. Nawrocki

[57] ABSTRACT

Apparatus for producing metal powders by atomization, the apparatus including melting means for melting the material to be atomized, an atomizing enclosure in which a dispersion head rotating at high speed is disposed to scatter the molten material in atomized form, means for cooling the atomized material and the head, and means for collecting the cooled powder material obtained in this way, said melting means including at least one vertical inductive plasma furnace producing an envelope of plasma-generating gases containing the top face of the dispersion head, and said cooling means comprising both a first series of members for dispensing a cooling fluid disposed in the top portion of the atomizing enclosure to create a cold zone at the periphery of the envelope, and a second series of members for circulating a cooling fluid disposed in the bottom portion of the enclosure to create a cold zone at the bottom face of the head.

20 Claims, 4 Drawing Sheets

METHOD AND APPARATUS FOR PRODUCING POWDERS

The present invention relates to a method and apparatus for producing powders, and in particular metal powders by atomization.

BACKGROUND OF THE INVENTION

Installations already exist for producing metal powders in which atomization techniques are used. In those known techniques, molten metal is poured onto a horizontal disk driven in rotation by a spindle rotating about a vertical axis. The metal is then projected outwards from the disk under the effect of centrifugal force and it splits up into fine droplets of metal which solidify on coming into contact with a fluid or with a cold wall.

Nevertheless, in all present techniques, the main drawbacks are firstly the problem of the powder being polluted during the operations of melting, atomizing, quenching, and collecting, and secondly the difficulties encountered in atomizing a liquid of a material that is perfectly uniform.

An object of the present invention is to overcome these technical problems and in particular to make it possible to disperse a suitably hot metal liquid without there being any chemical interaction between the dispersion means and the liquid, to create a quenching zone in which any possibility of pollution of the atomized liquid is eliminated, and to provide a "cold-chain" making it possible to use the resulting powders without polluting them prior to manufacturing the final solid product, by compacting and sintering.

SUMMARY OF THE INVENTION

This object is achieved, according to the invention, by means of apparatus for producing powders, and in particular metal powders by atomizing, the apparatus comprising melting means for melting the material to be atomized, an atomizing enclosure in which a dispersion head is disposed rotating at high speed to scatter the molten material in atomized form, means for cooling the atomized material and the head, and means for collecting the cooled powder material obtained in this way, wherein said melting means comprise at least one vertical inductive plasma furnace producing an envelope of plasma-generating gases containing the top face of the dispersion head, and wherein said cooling means comprise both a first series of members for dispensing a cooling fluid and disposed in the top portion of the atomizing enclosure to create a cold zone at the periphery of the envelope, and a second series of members for circulating a cooling fluid, said series being disposed in the bottom portion of the enclosure to create a cold zone at the bottom face of the head.

Advantageously, said first series of members for dispensing a cooling fluid is constituted by a ring of nozzles producing jets of fluid tangentially to the surface of said envelope, and nozzles producing tangential washing of the enclosure.

According to another feature of the invention, said envelope of plasma-generating gases is constituted by a cylindrical tube whose vertical axis is parallel to the vertical axis of the rotary head, and preferably the axis of the cylindrical tube coincides with the axis of the head.

According to another feature of the invention, said vertical inductive plasma furnace is disposed above the top face of the rotary head.

The invention also provides a method of manufacturing powders, and in particular metal powders, by atomization, the method comprising continuously melting the material to be atomized which flows vertically and coaxially down towards a dispersion head rotating at high speed for the purpose of dispersing the molten material in atomized form into an envelope of plasma-generating gases, and then quenching the atomized material and collecting the cooled powder material obtained in this way, wherein the molten material is atomized by being dispersed by friction on the top face of the rotary head and is quenched by said atomized material passing through a cooling vortex situated at the periphery of the envelope of plasma-generating gases.

The invention also provides ultrapure metal powders obtained by the above method.

By using the cooled dispersion head rotating at a speed of up to 125,000 revolutions per minute (rpm), the apparatus of the invention can absorb a large heat flow produced by a plasma torch and onto which the liquid material falls. The atomized material then penetrates into a quenching zone at the periphery of the head formed by a cylindrical tube of plasma-generating gases moving parallel to the vertical axis of the head and enveloped in cold fluid. Finally, the powder obtained is recovered in a collection zone including at least one chamber containing an inert gas in the gaseous, liquid, or solid state prior to utilization of the powder in shaped or formed products.

A powder obtained by the method of the invention with very fast cooling is ultrapure and possesses grains that are very fine in size.

BRIEF DESCRIPTION OF THE DRAWINGS

An embodiment of the invention is described by way of example with reference to the accompanying drawings, in which.

DETAILED DESCRIPTION

Figure 1:
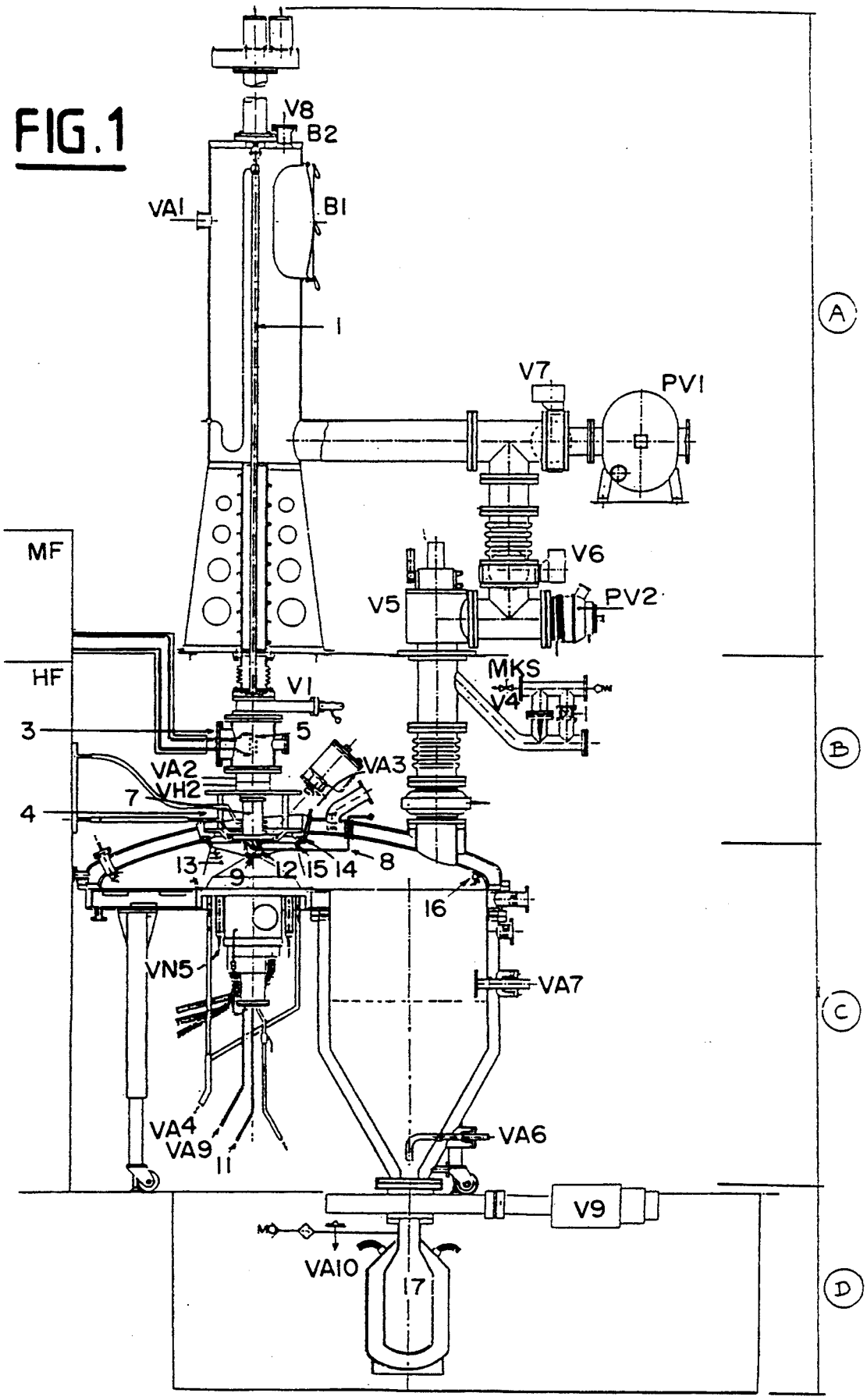
FIG. 1 is a diagram of atomizing apparatus of the present invention.
Figure 2:
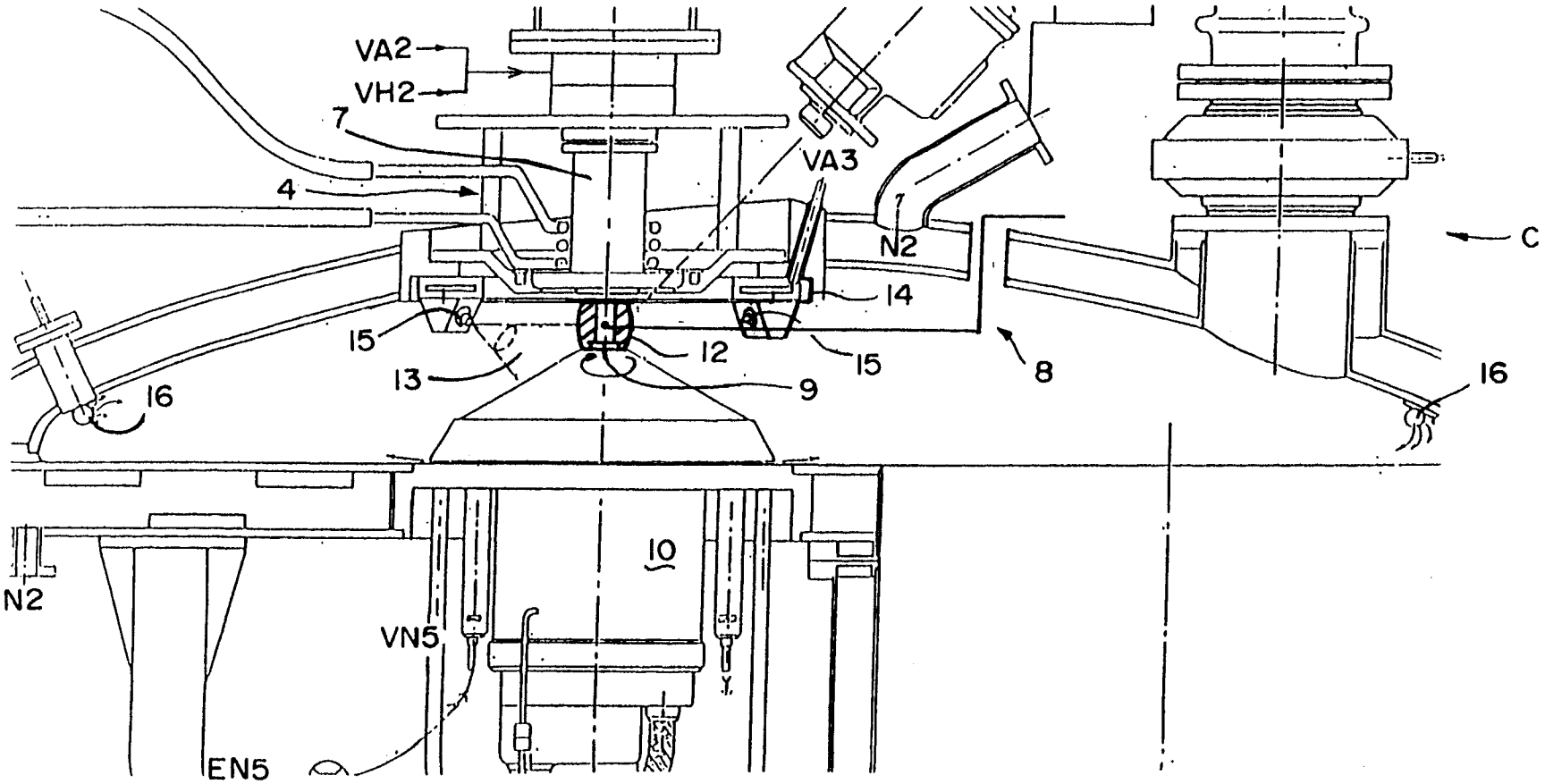
FIG. 2 is an enlarged view of the central portion of the apparatus of FIG. 1.

As shown in FIGS. 1 and 2, the material to be melted and atomized is inserted via feed means A into the device, e.g. initially in the form of a cylindrical rod 1 whose diameter is determined relative to the power of the melting means, constituted, in particular, by a plasma furnace B.

In variant implementations of the method, the material to be atomized is initially in the form of pieces of various sizes, of powder, of small shot, or it may be conveyed in the molten state directly to the apparatus.

The rod 1 is disposed vertically on the axis of the furnace B, with valve V1 then being closed, keeping the furnace B and the enclosure C under en inert atmosphere. After the rod feed chamber A has been evacuated and purged several times, the valve V1 is opened. The rod 1 is then lowered by means of an electromechanical or hydropneumatic actuator which is regulated to a speed that corresponds to the desired casting rate. The rod is preheated in a preheating furnace 3 by electrical current induced from one or more inductive turns 5 at a frequency lying in the range 10 kHz to 30 kHz, depending on the diameter of the rod.

The material to be atomized can also be melted by means of apparatus for direct induction melting in a cold cage with electromagnetic confinement of the melt, as described in French patent No. 88 04 460.

The rod then penetrates into the inductive plasma furnace 4. The plasma is lighted by striking an electric arc between the rod raised to a high tension and a retractable moving electrode 8 which is grounded. Depending on the extent to which the rod is advanced into the flame during casting, the stream or the liquid drops of molten material spend(s) a greater or lesser period of time in the hottest portion of the plasma firstly to be superheated and secondly to pass through the most highly reactive zone of the furnace.

A cold cage 7 is preferably used to protect the furnace enclosure, and it is polished to increase the thermal efficiency of the plasma. The rod 1 is thus heated at its periphery by direct HF field induction (skin effect), and by conduction and thermal convection of the plasma-generating gases. It melts into a cone whose apex points downwards, with the angle of the cone being a function of the nature of the plasma-generating gases. Thus, depending on the power of the furnace and on the penetration of the rod into the plasma, casting is obtained which is accurately axial, and either continuous or non-continuous. As to the diameter of the liquid flow or of the drops, it is a function of the liquid flow rate and of the cone angle of the cone.

Figure 4A:
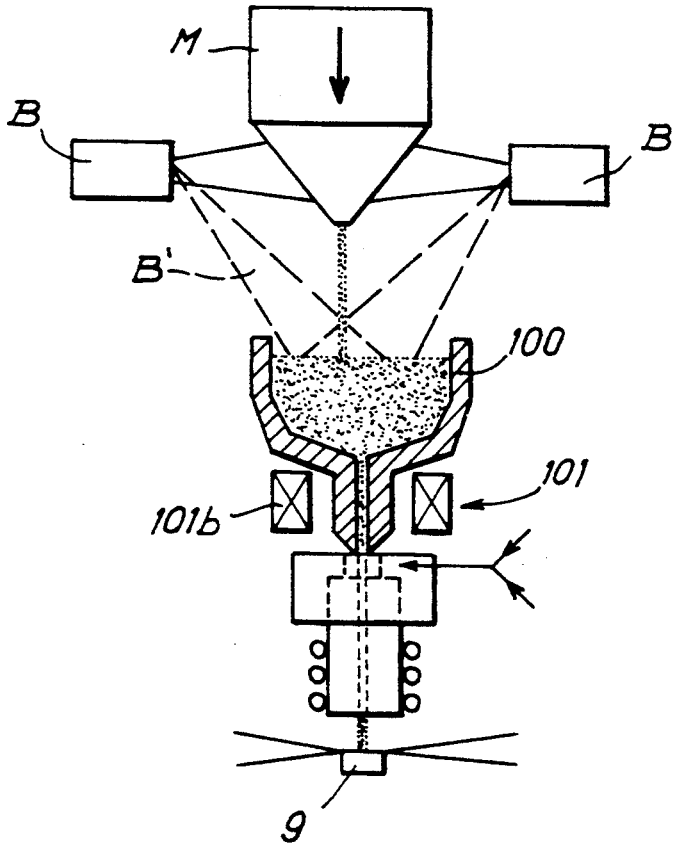
FIGS. 4*a* and 4*b* are diagrams showing embodiments of means for melting metal and for feeding molten metal to the atomizing enclosure.
Figure 4B:
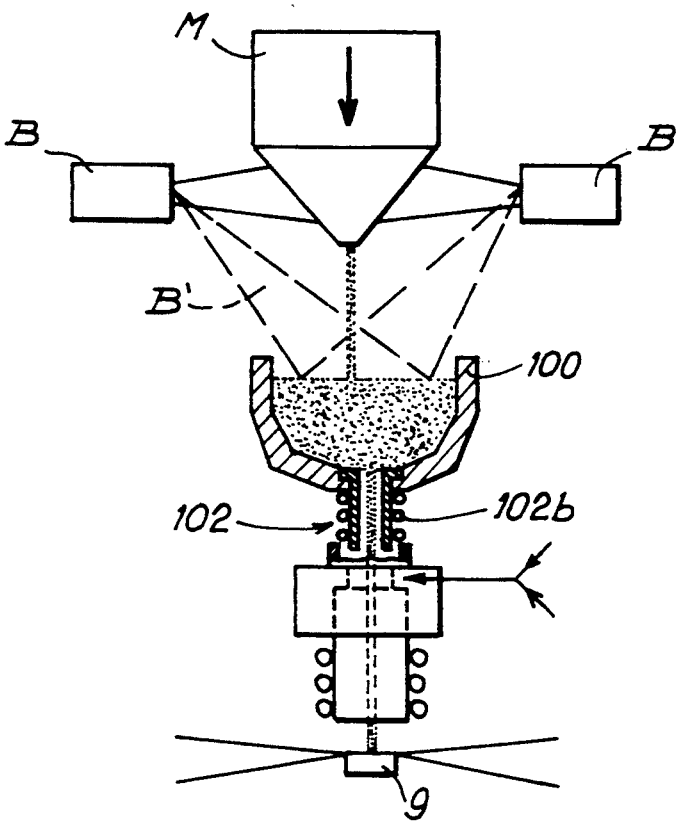

Under such conditions, the material to be atomized is initially received in molten form in a cold crucible (as in French patent 2 697 050) from which it flows under gravity, passing through an electromagnetic and/or composite nozzle prior to penetrating into the atomizing enclosure as shown in FIGS. 4*a* and 4*b*. The electromagnetic and/or composite nozzle constitutes means for feeding and regulating the flow rate of molten metal and optionally serves to keep the metal in the desired thermal state.

The apparatus shown in FIGS. 4*a* and 4*b* comprises means (B) for melting the solid material M (metal), e.g. constituted by a plasma torch. The molten material then flows into a cold crucible 100 to form a bath of molten metal. Heat losses from the surface of the bath may optionally be compensated by additional heating means B'. The material in the molten state then flows vertically through the bottom of the crucible and through an electromagnetic nozzle 101 (FIG. 4*a*) or a composite nozzle 102 (FIG. 4*b*).

French patent No. 87 00 866 describes a composite nozzle 102 used for controlling the flow rate of a liquid metal, and operating, for example, with a coil 102*b* at 450 kHz.

The electromagnetic nozzle 101 comprises a peripheral coil 101*b* inducing a high frequency field so as to constrict the flow of liquid, thereby varying the flow rate of the molten material. The molten material then penetrates into the atomizing enclosure where it comes into contact with dispersion head 9.

In FIGS. 1 and 2, the molten material flows into the atomizing enclosure C via the center of the top face of the dispersion or atomizing head which is caused to rotate by the spindle 10 at a speed which may reach 125,000 revolutions per minute (rpm). The shape of the dispersion head 9 is determined as a function of the optimum temperature distribution and, advantageously, it is implemented in the form of a cylinder whose dimensions are determined by the nature of the material from which it is made and of the desired temperature on the top face that comes into contact with the molten material, as a function of the grain size required for the powder. The top face of the head is preferably situated in a plane that is substantially horizontal and that has a flow of heat passing vertically therethrough as generated by the plasma-generating gases heated by induction in the inductor 6. The plasma zone is constituted by an envelope of the plasma-generating gas in the form of a cylindrical tube whose vertical axis is parallel to the vertical axis of said head 9, being close thereto or coinciding therewith. The bottom face of the cylindrical head 9 and the spindle 10 are cooled by axial circulation 11 of a cooling fluid which may either be water for larger heat flows or else a gas or a liquefied gas such as helium or argon, for example, whenever a higher surface temperature is desired for the head.

The cylindrical atomizing head 9 may either be made of copper or of tungsten, or of an alloy that is refractory or otherwise, depending on the surface temperature that is to be reached.

The bottom face of the cylinder constituting said head 9 is advantageously provided with a hemispherical cavity having the cooling fluid 11 that flows axially sweeping thereover. The cooling of the bottom face of the head 9 establishes a temperature gradient therein which, for copper, lies in the range 60° C./cm to 180° C./cm, and for tungsten lies in the range 200° C./cm to 500° C./cm.

The heat delivered by the plasma to the liquid metal up to the surface of the head, and the thermal resistance between the liquid material and said head ensure that the material being dispersed remains liquid (in spite of the heat extracted through the head).

To increase the thermal resistance and, firstly to have a dispersion head which is as cold as possible given its mechanical properties, and secondly to have a liquid for dispersing which is hot enough to remain homogeneous, atomization is performed by "erosion", where "erosion" consists in scattering and dispersing the liquid by friction, thereby preventing it from "wetting" the top face of the head.

Using the plasma torch makes it possible:

a to melt the material under optimum thermodynamic and geometrical conditions, thereby obtaining a flow that is accurately axial and stable;

b to heat the stream of liquid so as to obtain a liquid that is homogeneous;

c to create a flow of heat through the top face of the atomizing head 9 and to ensure a temperature distribution that is compatible with the mechanical performance of said head; and d to maintain the purity of the substances being atomized up to quenching thereof.

After being atomized, the particles of liquid pass directly from the plasma zone 12 surrounding the head to a quenching zone 13 constituted by a cooling medium which may be two-phase or otherwise, and which forms a vortex around the plasma. To this end, a series of nozzles 15 placed on a ring 14 at the top of the atomizing enclosure C deliver the cooling liquid tangentially to the tube of plasma-generating gases 12.

Figure 3:
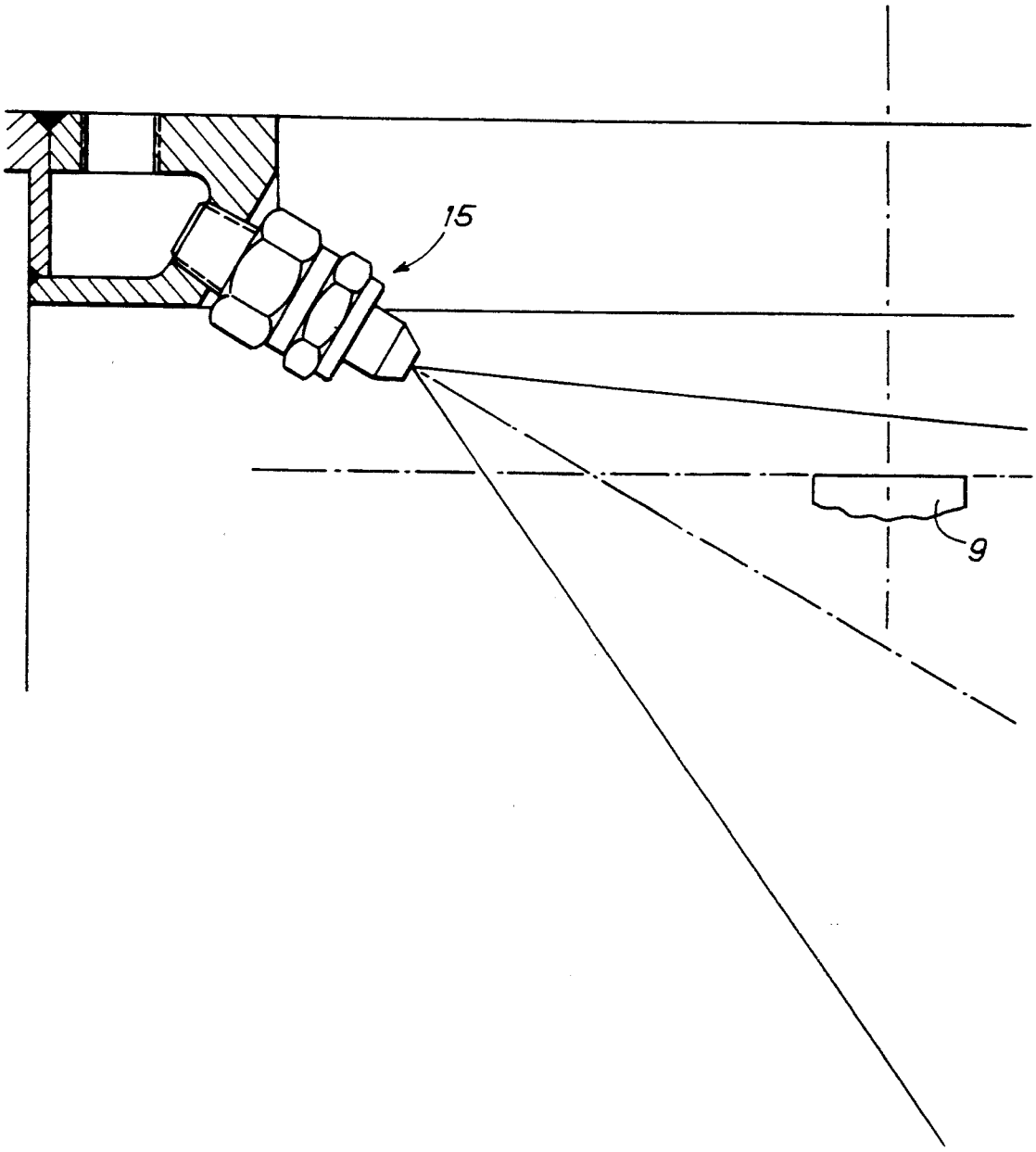
FIG. 3 shows the quenching zone together with the members for dispensing the cooling fluid.

In an advantageous embodiment as shown in FIG. 3, a ring of eighteen nozzles 15 is provided delivering a total flow of liquid argon that is sufficient to cool the powder completely. The ejection axes X of the nozzles 15 slope relative to the plane of the top face of the head 9, and the width of the is determined in such a manner as to obtain rapid cooling and a counter-rotating effect, i.e. rotation in the opposite direction to that of the head 9 so as to brake the motion of the powder.

The ejection orifices of the nozzles 15 are situated above the powder ejection triangle.

Passing from the plasma zone constituted by the envelope of high temperature plasma-generating gases 12 to the low temperature quenching zone 13 serves firstly to eliminate chemical reactions that occur between 1500° C. and 200° C. and most particularly to eliminate oxidizing reactions when atomizing metals or alloys, and secondly to prevent the formation of intermediate phases that prevent microcrystalline or even amorphous structures being obtained.

The cooling vortex 13 constituted in this way entrains the particles that ere initially liquid and then solid along spiral trajectories, thereby avoiding firstly direct shocks against the walls of the enclosure C, and secondly gas turbulence towards the top of the device, which turbulence could disturb the plasma and the atomization.

The nozzles 16 directed towards the walls of the enclosure project a spray of argon thereagainst which flows along the walls, thereby entraining powder downwards, and thus providing tangential washing of the enclosure.

The mixture of liquid and powder is deposited at the bottom of the enclosure C.

The resulting powder is thus deposited on the bottom of the enclosure C and is recovered in a container 17.

The cooling and collection of the powder are thus performed by using an inert gas in the gaseous, liquid, or solidified state after the collected powder has been immersed in the liquid phase.

The invention also provides for the possibility of combining in a single unit a plurality of atomizing apparatuses disposed around the energy sources: the medium frequency (MF) preheating generator and the plasma torch generator (HF).

The following description illustrates an implementation of the method of the invention described with reference to the apparatus shown in FIG. 1.

Example

Using the apparatus of the invention to provide 10 kg of alloy powder from two rods of 24 mm diameter.

The operation is semicontinuous, due to the sequence of two rods.

The procedure begins with the operation of loading rod No. 1 and then the operation of preheating using the 10 kHz to 30 kHz median frequency furnace, followed by the operations of melting by means of the 100 kW plasma torch, of centrifugal dispersion, and of cooling by means of liquid argon in gaseous helium, and finally by the operation of recovering the powder in the collector as cooled by liquid nitrogen.

Throughout the following description, D designates flow rate, P designates pressure, T designates temperature, V designates a valve, and B designates a flange.

PRELIMINARY OPERATIONS

Degassing at ambient temperature with pump PV1 and then with molecular pump PV2 to obtain a static vacuum of $10^{-5}$ torr in the enclosure containing the collector, the rotary head or disperser, the argon ducts, and the liquid argon accumulator.

Sweeping by argon U at 1 bar.

Closing the valve V1

Evacuating to $10^{-3}$ tort.

Filling with helium via the valve V4 end a device for regulating the pressure (MKS) to maintain it at 2 bars.

Opening the valve VA9 of the gas bearing for the gas to be dispersed, with PA9=2 bars.

Rotating the disperser at low speed, i.e. about 5,000 rpm.

Injecting cooling water into the head at a flow rate DE1 =10 grams per second (g/s).

Cooling the enclosure end the liquid nitrogen collector at 3 bars.

Cooling the accumulator at 2 bars.

Filling the accumulator by condensing argon U.

Injecting gaseous argon into the cold cage of the plasma torch via the valve VA2 at a flow rate DA2=0.3 liters per second (l/s).

Putting the argon accumulator (not shown) under pressure with PA6=3 bars, and opening the valves VA3, VA4, and VA5 to degas the liquid argon ducts and to prime the cryogenic pumps.

Filling the liquid nitrogen expansion tanks (not shown) up to levels "ni" respectively at pressures PNi=2 bars for i=1 to 6 .

| Operations A: LOADING | | DURATION (seconds) |
|---|---|---|
| A1 | Inserting and fixing rod No. 1 | 20 |
| A2 | Closing flanges B1 and B2 and valve V8 | 10 |
| A3 | Starting up vacuum pump PV1 | |
| A4 | Opening valve V7: vacuum <0.01 torr | 30 |
| A5 | Closing valve V7 and opening valve VA1, filling airlock to 3 bars, closing valve VA1 | 10 |
| A6 | Purging: opening valve V7 for a vacuum of les than 0.1 torr | |
| A7 | Closing V7 and stopping the vacuum pump PV1 | |
| A8 | Opening the airlock-enclosure valve V1 to fill the airlock with helium via valve V4 of the pressure regulator device (MKS) at 2 bars | 40 |
| | | 110 |

| Operations B and C: PREHEATING, MELTING, AND DISPERSION, CENTRIFUGING | | DURATION (seconds) |
|---|---|---|
| B1 | Starting 30 kW MF generator | 5 |
| B2 | Lowering the rod: at a speed Vb of 5 cm/s to HF inductor I2 (2) | 10 |
| C2 | Inserting gases into the head of the plasma torch: opening valve VA2, valve VH2 being closed argon U: DA = 0.3 l/s; hydrogen: DH2 = 0 | |
| LN2 | (LN2 = liquid nitrogen) Nitrogen pressure in the dispersal cap: PN5 = 6 bars | |
| C3 | Lighting the plasma at 18 kW by a 6 kV HF electric arc between the rod and a moving grounded electrode, and then raising the rod to the MF inductor I1(1) | 20 |
| C4 | Raising the maximum power of the plasma to 50% | |
| C5 | Increasing the argon flow rate to DA2 = 0.5 l/s and injecting hydrogen, by opening VH2, with DH2 = 0.0025 l/s | 5 |
| LN2 | Lowering temperatures and thus nitrogen pressures in: | |
| | top jacket of enclosure: PN1 = 1 bar | |
| | bottom jacket of enclosure: PN2 = 1.6 bars | |
| | jacket of accumulator: PN4 = 1.6 bars | |
| | jacket of argon ducts: PN6 = 1 bar | |
| C6 | Opening the high pressure liquid argon valve VA3: DA3 = 0.075 l/s (PA3 = 10 bars) | 10 |
| B3 | Raising the MF generator to power PMo, | 5 |

-continued

| | | |
|---|---|---|
| | to obtain Tb | |
| B4 | When the temperature of the rod is at fixed Tb, lowering the rod at speed Vb = 0.27 cm/s (10 g/s) and adjusting the power PMo to maintain Tb while the rod is moving | 100 |
| C7 | Same as C4 at 100% and C5 with the following flow rates: DH2 = 0.005 l/s, DA2 = 1 l/s<br>Raising the speed of the rotary head: Vrd = 1,000 rpm | 10 |
| C8 | Liquid argon through the cooling nozzles: DA = 0.15 l/s; PA3 = 20 bars | |
| C9 | Stroke of the rod = 125 cm in the plasma at Vb = 0.27 cm/s | 455 |
| C10 | Stop preheating | |
| C11 | 10 cm stroke of the rod through the plasma at Vb = 0.27 cm/s | 40 |
| D1 | Raising the rod (140 cm) at the speed Vb = 20 m/s | |
| D2 | Closing the valve V1 separating the enclosure from the airlock | |
| C12 | Reducing the plasma generator to 18% of its maximum power: DH2 = 0 and DA2 = 0.3 l/s<br>Reducing the speed of the head Vrd = 80 rpm | |
| LN2 | PN1 = 1.6 bars, PN2 = 2 bars, PN3 = 2 bars, DA5 = 10 g/s, PN6 = 2 bars | |
| | Duration of melting | 660 |

| Operations E, D, and A: WASHING, UNLOADING, LOADING | | DURATION (seconds) |
|---|---|---|
| D3 | Depressurizing the airlock: opening valve V8 | |
| D4 | Cooling the rod: opening valve VA1 | |
| E1 | Opening VA4, VA7 being closed for washing the bottom of the enclosure, flow rate DA4 = 1 l/s | 20 |
| E2 | 2 seconds after opening VA4 and for 5 seconds, opening VA5, flow rate DA5 = 1 l/s | |
| E5 | Partial settling of the powder (>30 μm) | 50 |
| D5 | Opening the flange B2 | |
| D6 | Closing the valve VA1 | |
| D7 | Opening the port B1 | |
| D8 | Releasing and extracting the remains of the rod | |
| | | 70 |
| E6 | Two options are possible | |
| | total settling of the power >5 μm | 1200 |
| | refilling the accumulator with liquid argon | 60 |
| | During this time, the A operations for rod No. 2 are performed from A1 to A7 | |
| A8 | Opening the valve VA1 to fill the airlock to 2 bars | |

| Operations B and C: PREHEATING, MELTING, AND DISPERSION, CENTRIFUGING | | DURATION (seconds) |
|---|---|---|
| A9 | Opening the enclosure-airlock valve V1 | 5 |
| C4 | Raising the plasma to 50% of maximum power | |
| C5 | DA2 = 0.5 l/s and hydrogen is inserted DH2 = 0.0025 l/s | 5 |
| LN2 | Lowering temperatures and thus pressures of the nitrogen as follows: | |
| | top jacket of enclosure: PN1 = 1 bar<br>bottom jacket of enclosure: PN2 = 1.6 bars<br>jacket of accumulator: PN4 = 1.6 bars<br>jacket of argon ducts: PN6 = 1 bar | |
| C6 | Opening the high pressure liquid argon valve VA3: DA3 = 0.075 l/s (PA3 = 10 bars) | 10 |
| B3 | Raising the power PMo of the MF generator to obtain Tb | 5 |
| B4 | When the temperature of the rod is at stationary Tb, lowering the rod 25 cm at a speed Vb = 0.27 cm/s (10 g/s) | 100 |
| C7 | Same as C4 at 100% and C5 at the following flow rates: DH2 = 0.0051 l/s, head speed raised by Vrd = 1,000 rpm | 10 |
| C8 | Liquid argon through the cooling nozzles: DA3 = 0.15 l/s; PA3 = 20 bars | |

-continued

| | | |
|---|---|---|
| C9 | 125 cm stroke of rod through the plasma at Vb = 0.27 cm/s | 455 |
| C10 | Stopping preheating | |
| C11 | 10 cm stroke of the rod through the plasma at Vb = 0.27 cm/s | 40 |
| C12 | Stopping or lowering the plasma generator to 18% of maximum power, stopping H2 and reducing argon at DA2 to 0.3 l/s<br>Reducing the speed of the head Vrd = 80 rpm | |
| LN2 | PN1 = 1.6 bars, PN2 = 2 bars, PN3 = 2 bars, DA5 = 10 g/s, PN6 = 2 bars | |
| | Duration of melting | 630 |

| Operations E, D, A, and G: WASHING, UNLOADING, LOADING, HEAD | | DURATION (seconds) |
|---|---|---|
| D1, D2, D3, D4, E1, D2, E5, D5, D6, D7, D8 | | |
| E6 | Settling of the powder | |
| Operations A: A1, A2, A3, A4, A5, A8, A7, A8 | | |
| Changing the dispersion if necessary | | |
| Operation G | | |
| G1 | closing the head of the cap by the capsule-electrode | |
| G2 | Closing the valves VE1 and VN5<br>Emptying out the water and the nitrogen | 1200 |
| G3 | Stopping and then removing the motor | |
| G4 | Changing the dispersion head or Polishing the head | |
| G5 | Reinstalling the disperser | |
| G6 | Degassing and represurizing the disperser enclosure | |

| Operations F: TRANSFER | | DURATION (seconds) |
|---|---|---|
| F1 | Emptying the bottom of the tank by opening the valve VA6 (using an auxiliary cryogenic accumulator tank) | 30 |
| F2 | Closing the valves VA6 and V9 | 20 |
| F3 | Extracting the collector and replacing it with a second collector | 60 |
| F4 | Reheating the first collector by emptying out the liquid nitrogen and by passing hot air through the jacket<br>Degasing the second collector in a vacuum, with VA10 open | 120 |
| F6 | Cooling the second collector with liquid nitrogen | |
| | | 230 |

To obtain 10 kg of alloy powder in a collector, the following are required:

1 hour 8 minutes with emptying between two rods or 48 minutes filling the liquid argon accumulator with spare liquid argon.

The method end the apparatus of the invention enable powders of various families of materials to be manufactured, in particular super alloys based on nickel, titanium and alloys of titanium, aluminum, alloys of niobium, etc.

What is claimed is:

1. A method of manufacturing metal powders by atomization, comprising the steps of: continuously melting metal material to be atomized, which material flows vertically and generally coaxially with respect to a plasma furnace down towards a dispersion head rotating at high speed within a range of between 30,000 rpm and 125,000 rpm for the purpose of dispersing molten material thereby created in atomized form into an envelope of plasma-generating gases, then quenching the atomized material, and collecting cooled powder material thereby obtained, wherein the molten material is atomized by being dispersed by friction along a top surface of the dispersion head and is quenched by said atomized material passing through a cooling vortex situated at the periphery of the envelope of plasma-generating gases.

2. A method according to claim 1, wherein the powder material is collected under an inert gas.

3. A method according to claim 1, wherein atomization is performed at pressures greater than about 14.69 pounds per square inch.

4. A method according to claim 1, wherein generated plasma is lighted by striking a high tension electric arc between the metal material and an electrode plate on an axis of the plasma furnace.

5. A method according to claim 1, wherein the atomized material is quenched by being brought into contact with a cold gaseous material to thereby enable monocrystalline or amorphous structures to be obtained.

6. A method according to claim 1, wherein the atomized material is quenched by means of nozzles dispensing a flow of liquid argon that is sufficient to cool substantially all the atomized material to a powder form; ejection axes of said nozzles being inclined relative to a plane of the top surface of said dispersion head, and the width of jets of the liquid argon being generated so as to produce a counter-rotating effect thereof relative to said head so as to retard the motion of the powder.

7. A method according to claim 1, wherein the metal material to be atomized is initially in the form of a cylindrical rod.

8. A method according to claim 1, wherein the metal material to be atomized is initially in a molten state in a relatively cold crucible from which it flows through a flow adjustment nozzle towards an atomizing enclosure.

9. A method of manufacturing metal powders by atomization, said method comprising the steps of: continuously melting material to be atomized in a plasma produced by a high frequency electromagnetic field in a coil with one or more inductive turns, causing said material to flow vertically down to a location of most concentrated plasma and coaxially with the inductive turns in order to be superheated before contacting a dispersion head rotating at high speed, dispersing molten material thus created in atomized form into an envelope of plasma-generating gases, and then quenching the atomized material by passing the material through a cooling vortex produced by a ring of nozzles situated at the periphery of an envelope of the plasma-generating gases, wherein an axis of the envelope is parallel to an axis of the dispersion head, and collecting cooled powder material thus obtained.

10. A method according to claim 9 wherein the powder is collected under an inert gas.

11. A method according to claim 9 wherein atomization is performed at pressures greater than 3 bars.

12. A method according to claim 9 wherein the atomized material is quenched by being brought into contact with a cold gaseous material, thereby enabling monocrystalline or amorphous structures to be obtained.

13. A method according to claim 9 wherein the gases produced during quenching are liquified in a condenser and the powder material is recovered to form a mixture with a fraction of the liquefied gases in at least one container enabling the mixture to be maintained in a liquid or solid state.

14. A method according to claim 9 wherein the dispersion head is rotated at a speed in the range of between 30,000 rpm to 125,000 rpm.

15. A method according to claim 9 wherein a temperature gradient is established in the dispersion head of 60° C./cm to 180° C./cm and the dispersion head is made of copper.

16. A method according to claim 9 wherein a temperature gradient is established in the dispersion head of 200° C./cm to 500° C./cm and the dispersion head is made of tungsten.

17. A method according to claim 9 wherein the atomized material is quenched by means of nozzles dispensing a flow of liquid argon that is sufficient to cool the powder completely; the ejection axes of said nozzles being inclined relative to a plane of the top surface of said dispersion head, and the width of jets of the liquid argon being generated so as to produce a counter-rotating effect relative to said head so as to retard motion of the powder.

18. A method according to claim 9 wherein the material to be atomized is initially in the form of a cylindrical rod.

19. A method according to claim 9 wherein the material to be atomized is initially received in the molten state in a relatively cold crucible from which it flows through a flow adjustment nozzle towards an atomizing enclosure.

20. A method of manufacturing metal powders by atomization, comprising the steps of:

continuously melting metal material to be atomized, which material flows vertically and generally coaxially with respect to a plasma furnace down towards a dispersion head rotating at a high speed for the purpose of dispersing molten material thereby created in atomized form into an envelope of plasma-generating gases, then quenching the atomized material, and collecting cooled powder material thereby obtained, wherein the molten material is atomized by being dispersed by friction along a top surface of the dispersion head and is quenched by said atomized material passing through a cooling vortex situated at the periphery of the envelope of plasma-generating gases, wherein the gases produced during quenching are liquified in a condenser and the powder material is recovered with a fraction of the liquified gases to form a mixture in at least one container, and enabling the mixture to be maintained in a liquid or a solid state.

* * * * *